US005232053A

United States Patent [19]

Gillis et al.

[11] Patent Number: 5,232,053

[45] Date of Patent: Aug. 3, 1993

[54] EXPLOSION SUPPRESSION SYSTEM

[75] Inventors: Joseph P. Gillis, Westborough; Jordan N. Jacobs, Randolph, both of Mass.

[73] Assignee: Fenwal Safety Systems, Inc., Marlborough, Mass.

[21] Appl. No.: 571,700

[22] Filed: Aug. 24, 1990

[51] Int. Cl.[5] ..... A62C 35/08

[52] U.S. Cl. ..... 169/58; 169/28

[58] Field of Search ..... 169/28, 58

[56] References Cited

U.S. PATENT DOCUMENTS

| | | | |
|---|---|---|---|
| 2,405,125 | 8/1946 | Barnard | 169/28 |
| 2,742,094 | 4/1956 | Mathisen | 169/28 |
| 2,766,832 | 10/1956 | Mathisen | 169/28 X |
| 2,884,076 | 4/1959 | Mathisen | 169/28 X |
| 3,333,641 | 8/1967 | Hansom et al. | 169/28 X |
| 3,604,511 | 9/1971 | Griffith | 169/28 |
| 3,799,270 | 3/1974 | Boud | 169/28 |
| 3,834,463 | 9/1974 | Allard et al. | 169/28 |
| 4,126,184 | 11/1978 | Hinrichs | 169/28 X |
| 4,328,867 | 5/1982 | Heath | 169/28 X |
| 4,394,868 | 7/1983 | McLelland | 169/58 X |

FOREIGN PATENT DOCUMENTS

| | | | |
|---|---|---|---|
| 405406 | 8/1943 | Italy | 169/28 |

*Primary Examiner*—Margaret A. Focarino
*Assistant Examiner*—James M. Kannofsky
*Attorney, Agent, or Firm*—John E. Toupal; Harold G. Jarcho

[57] ABSTRACT

An explosion protection system including a container adapted to contain an explosion suppressant under pressure and defining a discharge outlet; a primary storage volume, and an auxiliary storage volume disposed between the discharge outlet and the primary storage volume and communicating therewith; a closure member covering the discharge outlet; an explosive charge disposed in the container adjacent to the closure member and adapted to create explosive forces that rupture the closure member; and a dispersible explosion suppressant retained under pressure in the primary storage volume and having a given degree of compressibility. Also included is an explosive force transmitting agent filling the auxiliary storage volume and having a degree of compressibility less than the given degree.

20 Claims, 1 Drawing Sheet

EXPLOSION SUPPRESSION SYSTEM

BACKGROUND OF THE INVENTION

This invention relates generally to an explosion suppression system and, more particularly, to an explosion suppression system in which a dry powder suppressant is discharged in response to detection of an explosive condition.

High rate discharge (HRD) extinguishing systems are extensively used to suppress potentially destructive dust and vapor explosions occurring in inherently hazardous processes and applications. A typical HRD suppression system is disclosed in U.S. Pat. No. 2,766,832. Most commonly employed in HRD systems were halogenated liquid suppressants which are currently being replaced by environmentally friendly dry powder suppressants such as sodium bicarbonate and mono-ammonium phosphate. It has been found, however, that when dry powder suppressants are used in conventional HRD containers, the reliability of suppressant discharge is reduced. The reduced reliability results from an increased difficulty in rupturing with explosive charges the closure members typically used on the HRD containers. Since the dry powder suppressant is pressurized with a compressible gas such as nitrogen, the gas tends to absorb the shock wave created by firing of the explosive initiator to thereby attenuate the strength of the shock wave transmitted to the frangible closure member.

The object of this invention, therefore, is to provide an improved HRD explosion suppression system employing a dry powder suppressant.

SUMMARY OF THE INVENTION

The invention is an explosion protection system including a container adapted to contain an explosion suppressant under pressure and defining a discharge outlet; a primary storage volume, and an auxiliary storage volume disposed between the discharge outlet and the primary storage volume and communicating therewith; a closure member covering the discharge outlet; an explosive charge disposed in the container adjacent to the closure member and adapted to create explosive forces that rupture the closure member; and a dispersible explosion suppressant retained under pressure in the primary storage volume and having a given degree of compressibility. Also included is an explosive force transmitting agent filling the auxiliary storage volume and having a degree of compressibility less than the given degree. The agent transmits the explosive forces created by the explosive charge to the closure member insuring rupture thereof.

According to certain features of the invention, the explosive charge is immersed in the agent which isolates the suppressant from the discharge outlet. This arrangement insures transmission by the agent of the explosive forces.

According to other features of the invention, the suppressant comprises a particulate matter and compressible gas mixture, and the agent comprises a substantially non-compressible gel substance. These materials improve the reliability of the suppression system.

According to another feature of the invention, the auxiliary storage volume is substantially smaller than the primary storage volume. This feature enhances the efficiency of the suppressor system.

According to yet another feature of the invention, the system includes a removable cartridge retaining the agent. The cartridge facilitates placement of the agent within the auxiliary volume.

According to still other features of the invention, the container further defines a discharge channel forming the auxiliary storage volume; and the cartridge comprises side walls conforming substantially to the channel, a first easily ruptured end wall separating the primary volume from the auxiliary volume, and a second easily ruptured end wall conforming substantially to the closure member. These features enhance the performance of the force transmitting agent.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
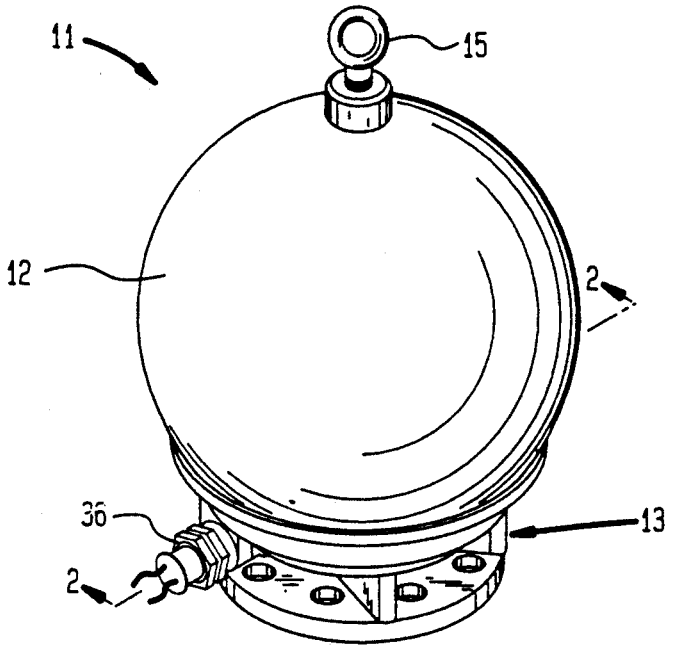
FIG. 1 is a perspective view of an HRD suppression system according to the invention.
Figure 2:
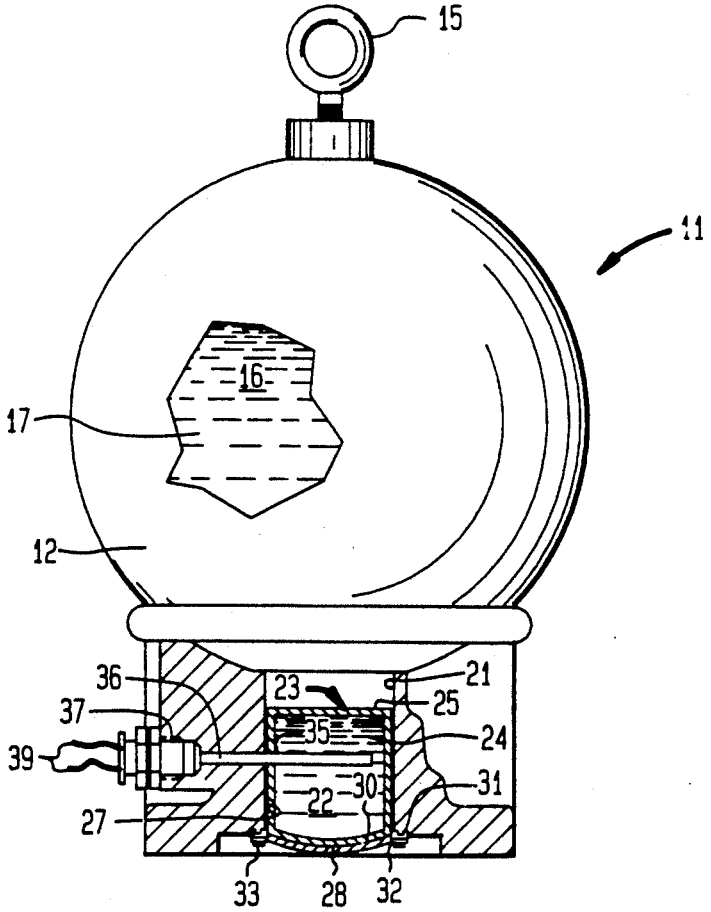
FIG. 2 is a partially cut away and sectioned view of the suppression system shown in FIG. 1.

An explosion suppression system 11 according to the invention is illustrated in FIGS. 1 and 2. The extinguishing system 11 includes a spherical container 12 supported on a base 13 having a bottom adapted for mounting in an explosive environment. Fixed to an upper end of the spherical container 12 is a ring 15 for use in transporting and positioning of the extinguisher 11. The spherical container 12 defines a primary volume 16 that is filled with a mixture 17 consisting preferably of a dry powder suppressant such as sodium bicarbonate or mono-ammonium phosphate and a non-flammable, non-oxidizing pressurizing gas such as nitrogen.

Formed in the extinguisher base 13 is a discharge channel 21 projecting downwardly from an opening in the bottom of the spherical container 12. The discharge channel 21 defines a cylindrical, auxiliary volume 22 that communicates with the primary volume 16 within the spherical container 12. Retained within the auxiliary volume 22 is a cylindrical cartridge 23 having sidewalls that conform to the inner walls of the discharge channel 21. The cartridge 23 and therefore the auxiliary volume 22 are filled with a substantially non-compressible gel such as, for example, petroleum jelly exhibiting a degree of compressibility substantially less than a given degree of compressibility exhibited by the suppressant mixture 17.

An easily ruptured top wall 25 of the cartridge 23 isolates the gel 24 from the suppressant mixture 17 in the spherical container 12. Covering a discharge outlet 27 formed at an outer end of the discharge channel 21 is a frangible disc member 28 conforming to an easily ruptured bottom wall 30 of the cartridge 23. An outer periphery of the frangible disc 28 is retain ed between a pair of annular flanges 31, 32 by bolts 33. Extending into the discharge channel 21 through an opening 35 in the cartridge 23 is a cylindrical initiator well 36. A threaded coupling 37 provides a hermetical seal between the initiator well 36 and the base 13. Retained by the initiator well 36 is an explosive initiator charge (not shown) connected to a pair of initiator leads 39. The explosive charge retaining initiator well 36 is convention and well known in the prior art.

OPERATION

Prior to use, the primary volume 16 defined by the spherical container 12 is filled through the discharge channel 21 with a dry powder suppressant. The gel filled cartridge 23 then is inserted into the discharge channel 21 and the discharge outlet 27 sealed by the frangible disc 28. After insertion of the initiator well 36, the primary volume 26 within the spherical container 12 is charged through a fill port (not shown) with nitrogen to a predetermined pressure of, for example, 500 PSIG. In response to detection of an incipient explosion by a conventional detection system, (not shown) electrical current is conducted by the initiator leads 39 to the explosive charge in the initiator well 36. The shock wave produced by a resultant explosion is readily transmitted by the incompressible gel to the frangible disc 28 causing rupture thereof and opening of the discharge outlet 27. The pressurized suppressant mixture 17 therefore is rapidly expelled from the primary volume 16, through the discharge channel 21 and out of the opened discharged outlet 27 into the explosion protected region.

Obviously, many modifications and variations of the present invention are possible in light of the above teachings. For example, shock wave force transmitting agents 24 and suppressant mixtures 17 other than those specifically described can be advantageously employed with the disclosed suppressor system 11. It is to be understood, therefore, that the invention can be practiced otherwise than as specifically described.

What is claimed is:

1. An explosion protection system comprising:

a container adapted to contain an explosion suppressant under pressure and defining a discharge outlet; a primary storage volume, and an auxiliary storage volume disposed between said discharge outlet and said primary storage volume and communicating therewith;

a closure member covering said discharge outlet;

an explosive charge disposed in said container adjacent to said closure member and adapted to create explosive forces that rupture said closure member;

a dispersible explosion suppressant retained under pressure in said primary storage volume and having a given degree of compressibility; and an explosive force transmitting agent filling said auxiliary storage volume and having a degree of compressibility less than said given degree, said agent adapted to transmit said explosive forces to said closure member.

2. A system according to claim 1 wherein said explosive charge is immersed in said agent.

3. A system according to claim 1 or 2 wherein said agent isolates said suppressant from said discharge outlet.

4. A system according to claim 3 wherein said suppressant comprises a particulate matter and compressible gas mixture.

5. A system according to claim 4 wherein said agent comprises a substantially non-compressible gel substance.

6. A system according to claim 5 wherein said substance comprises a gel.

7. A system according to claim 6 wherein said gel comprises petroleum jelly.

8. A system according to claim 4 wherein said particulate matter is sodium bicarbonate or mono-ammonium phosphate.

9. A system according to claim 8 wherein said gas is nitrogen.

10. A system according to claim 9 wherein said agent comprises a substantially non-compressible substance.

11. A system according to claim 10 wherein said substance comprises a gel.

12. A system according to claim 11 wherein said gel comprises petroleum jelly.

13. A system according to claim 3 wherein said auxiliary storage volume is substantially smaller than said primary storage volume.

14. A system according to claim 13 wherein said suppressant comprises a particulate matter and compressible gas mixture.

15. A system according to claim 14 wherein said agent comprises a substantially non-compressible substance.

16. A system according to claim 13 wherein said container comprises a sphere defining said primary storage volume; and an open ended discharge channel in fluid communication with said sphere, defining said auxiliary storage volume, and closed by said closure member.

17. A system according to claim 1 including a removable cartridge retaining said agent.

18. A system according to claim 17 wherein said container further defines a discharge channel forming said auxiliary storage volume; and said cartridge comprises side walls conforming substantially to said channel, a first easily ruptured end wall separating said primary volume from said auxiliary volume, and a second easily ruptured end wall conforming substantially to said closure member.

19. A system according to claim 18 wherein said explosive charge is immersed in said agent.

20. A system according to claim 19 wherein said substance comprises a gel.

* * * * *